United States Patent [19]

Jongerius et al.

[11] 4,233,653

[45] Nov. 11, 1980

[54] LOW-PRESSURE MERCURY VAPOR DISCHARGE LAMP

[75] Inventors: Hermanus M. Jongerius; Rein W. van der Wolf, both of Eindhoven, Netherlands

[73] Assignee: U.S. Philips Corporation, New York, N.Y.

[21] Appl. No.: 852,070

[22] Filed: Nov. 16, 1977

[30] Foreign Application Priority Data

Nov. 19, 1976 [NL] Netherlands ..... 7612881

[51] Int. Cl.[3] ..... F21V 9/16

[52] U.S. Cl. ..... 362/84; 362/263; 313/174

[58] Field of Search ..... 362/84, 263, 217; 313/174, 189, 198, 203, 227-228, 225

[56] References Cited

U.S. PATENT DOCUMENTS

| | | | |
|---|---|---|---|
| 2,262,177 | 11/1941 | Germer | 313/174 X |
| 2,467,687 | 4/1949 | Noel | 362/84 X |
| 2,486,859 | 11/1949 | Kerkhof | 362/84 X |
| 2,733,371 | 1/1956 | Campbell | 313/185 |
| 3,005,102 | 10/1961 | MacHutchin et al. | 362/84 X |
| 3,260,846 | 7/1966 | Feuer | 362/84 X |
| 3,336,502 | 8/1967 | Gilliatt | 313/180 X |
| 4,020,378 | 4/1977 | Morehead | 313/225 X |

*Primary Examiner*—Peter A. Nelson

*Attorney, Agent, or Firm*—Robert S. Smith

[57] ABSTRACT

Low-pressure mercury vapor discharge lamp having a luminescent layer and a conductive transparent coating. An amalgam is disposed in the discharge space to reduce loss of light owing to greying of this layer.

1 Claim, 1 Drawing Figure

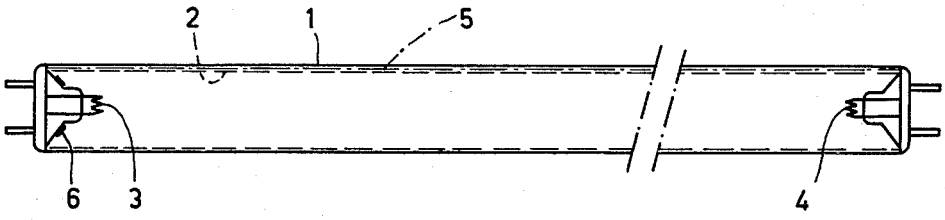
2
1
5
6
3
4

LOW-PRESSURE MERCURY VAPOR DISCHARGE LAMP

The invention relates to tubular glass low-pressure mercury vapor discharge lamps having a tubular glass envelope, two electrodes, a luminescent coating and a light-transmissive conductive layer disposed between this coating and the glass envelope. The layer is not connected to an electrode.

Lamps of the above-mentioned type are, for example, known from U.S. Pat. No. 2,733,371.

It is known that conductive layers for the above-mentioned lamps can advantageously be made of the oxides of tin or indium as the specific conductivity of these oxides can be varied within wide limits by so-called "doping" with other elements, for example, fluorine, oxygen, indium (for tin) or tin (for indium). So the total conductivity of these layers (from end to end) can easily be varied within wide limits by the quantity of doping material. It is therefore possible to satisfy, also for layers of a varying thickness, the requirements which must be imposed on the value of the starting voltage. The required starting voltage of the lamp depends of course closely on the voltage supplied by the supply unit (which is usually standardized).

Trials have shown that layers which originally satisfy the requirements imposed as regards light transmissivity and conductivity show greying after a comparatively small number of operating hours. This greying of course results in loss of light and an unaesthetic appearance, in particular because greying occurs irregularly, for example in the form of stains and dots. These stains and dots are found partially in the luminescent coating and partially in the conductive layer. The conductivity of the layer is substantially uniform.

German Pat. specification No. 1,086,804 discloses a low-pressure mercury vapor discharge lamp in which an amalgam of mercury and a carrier metal, for example, indium is used for determining the mercury vapor pressure during operation of the lamp. Consequently, it is possible to load the lamp higher or to operate it at higher ambient temperatures without the mercury vapor pressure increasing so much above the optimum vapour pressure that the conversion efficiency of the electric discharge energy into radiation decreases markedly. As known, this optimum mercury vapor pressure is at approximately $6\times10^{-3}$ torr, that is the saturation vapor pressure of mercury which has a temperature of approximately 40° C.

Amalgams, for example the one mentioned above, can furnish the same mercury vapor pressure of approximately $6\times10^{-3}$ torr at temperatures between approximately 60° C. and 100° C. Therefore they must be located in the discharge space in such a place that they are at this temperature during normal operation of the lamp, for example on the glass wall between the electrodes or in a place on a so-called foot stem, that is to say on a retreating glass wall portion which carries an electrode. In this last-mentioned embodiment the distance from the amalgam to the electrode must be made very large as otherwise, inter alia by radiation of the electrode which glows during operation, the temperature of the amalgam might become too high to supply the proper mercury vapor pressure.

As the vapor pressure-controlling amalgams often have a much lower mercury vapor pressure at temperatures below the operating temperature, these cold amalgam lamps start poorly at room temperature or at lower temperatures. In order to mitigate this drawback it was proposed (see, for example United Kingdom patent specification 1,131,566) to apply a second amalgam in a spot in the discharge tube which, after switch-on of the lamp is raised quickly to such a temperature that a sufficient quantity of mercury vapor is released from the amalgam into the discharge space to enable starting. This second amalgam can, for example, be applied on the pinch of a foot stem, just below an electrode. The means mentioned above to facilitate starting of low pressure mercury vapor discharge lamps, namely the use of a transparent conductive wall coating was of course considered as unattractive for amalgam lamps, on the one hand owing to the greying phenomena described above and, on the other hand, owing to the relatively high manufacturing cost of such lamps. For, not only an amalgam but also a conductive coating must then be applied.

From experiments which lead to the invention it was, however, surprisingly found that the use of the combination of an amalgam and a conductive coating as mentioned above has a great advantage. Greying of the conductive coating, especially the formation of concentrations of stains and dots is, namely, considerably less.

A low-pressure mercury vapor discharge lamp according to the invention is therefore characterized in that an amalgam is present in the discharge space of the lamp.

Lamps according to the invention can be constructed with pre-heatable electrodes as well as with electrodes which are only heated by the discharge, the so-called instant-start lamps. Therein the start times are fully comparable with lamps without an amalgam, even at low temperatures.

The invention will now be explained with reference to a drawing.

The drawing shows diagrammatically a longitudinal section of a 40 Watt low-pressure mercury vapor discharge lamp according to the invention. In this drawing reference 1 represents the glass wall of the envelope whose inner side is coated with a coat of luminescent material 2, for example consisting of calcium halophosphate activated by antimony and manganese. Electrodes 3 and 4 are disposed in the discharge space. Between the luminescent coating 2 and the glass wall 1 there is over substantially the full length of the lamp a conductive layer 5 which is not connected to the electrodes. This layer consists of tin oxide which is "doped" with such a quantity of indium that the resistance of the coating is approximately 2000 ohms per square. An amalgam 6 is located on the pinch of the lamp supporting the electrode 3. This amalgam consists, for example, of an alloy of indium and mercury.

What is claimed is:

1. A low-pressure mercury vapor discharge lamp for cooperation with an associated electrical power supply which comprises: a tubular glass envelope having first and second ends, first and second electrodes sealed respectively at said first and second ends of said envelope with connection means extending out of said envelope, an ionizable medium disposed in said tube which includes mercury, a light-transmissive conductive layer disposed on the inside of said glass envelope which is not connected to either electrode, said layer extending over substantially the full axial extent of said envelope and extending over less than the entire extent of the envelope at each axial cross-section, a luminescent coating disposed on said layer, and an amalgam disposed in said tube.

* * * * *